US006467206B1

(12) United States Patent
Bognár

(10) Patent No.: US 6,467,206 B1
(45) Date of Patent: Oct. 22, 2002

(54) MULTIPURPOSE ADVERTISEMENT DEVICE

(76) Inventor: József Bognár, Fény u.2., H-1024 Budapest (HU)

( * ) Notice: Subject to any disclaimer, the term of this patent is extended or adjusted under 35 U.S.C. 154(b) by 0 days.

(21) Appl. No.: 09/380,151

(22) PCT Filed: Feb. 25, 1998

(86) PCT No.: PCT/HU98/00018

§ 371 (c)(1),
(2), (4) Date: Oct. 22, 1999

(87) PCT Pub. No.: WO98/39760

PCT Pub. Date: Sep. 11, 1998

(30) Foreign Application Priority Data

Mar. 3, 1997 (HU) ..... 9700537
Aug. 21, 1997 (HU) ..... 9701441

(51) Int. Cl.[7] ..... G09F 19/00; G09F 19/08; A63H 33/26; A63H 23/08

(52) U.S. Cl. ..... 40/426; 40/415; 446/136; 446/135; 472/67

(58) Field of Search ..... 40/411, 414, 415, 40/426, 429; 446/136, 134, 267, 175, 135; 472/67

(56) References Cited

U.S. PATENT DOCUMENTS 2,630,765 A * 3/1953 Small
3,638,357 A * 2/1972 Groh
3,744,795 A * 7/1973 Lipscomb
3,810,515 A * 5/1974 Ingro
4,571,204 A * 2/1986 Wang
4,637,152 A * 1/1987 Roy
D295,085 S * 4/1988 Culley
5,301,444 A * 4/1994 Horiuchi
5,435,086 A * 7/1995 Huang
5,548,913 A * 8/1996 Randolph et al.
5,915,853 A * 6/1999 Guilin
6,131,318 A * 10/2000 Hsieh

* cited by examiner

*Primary Examiner*—Anthony Knight
*Assistant Examiner*—Vishal Patel
(74) *Attorney, Agent, or Firm*—Ladas & Parry

(57) ABSTRACT

The invention concerns a multipurpose advertisement device, with a carrier frame (1) comprising one or more border parts (2, 2') with an information carrying outer surface (2*c*) and with a primary information carrying means (4) for the displaying of characters and/or figures and/or other symbols for attracting attention. The primary information carrying means (4) have magnetic first connecting means (4*a*). Within the device there is a movable, rotating second connecting means (5*b*), with an attracting magnetic force between the first and second connecting means (4*a*, 5*b*). The primary information carrying means (4) is movably positioned on the outer surface (2*a*) of the device, and the second connecting means (5*b*) is positioned within the device in the proximity of the first connecting means (4*a*). The magnetic force is great enough for the primary information carrying means (4) to be attached to the surface of the information carrying outer surface (2*c*) of the carrier frame (1) and to be kept in place only by the attracting magnetic force acting between the first connecting means (4) and the second connecting means (5*b*) and by the frictional forces arising from said magnetic force.

21 Claims, 5 Drawing Sheets

MULTIPURPOSE ADVERTISEMENT DEVICE

TECHNICAL FIELD

The present invention concerns a multipurpose advertisement device, especially an advertisement device having a relatively large information carrying surface, and a mobile element for the purpose of attracting attention to the advertisement device, and therewith to the advertisement on the information carrying surface. The mobile element is kept in motion through magnets, with a magnetic first connection element contained in the mobile element, and a magnetic second connection means attached to a drive mechanism contained within the device, with magnetic attraction between the first and second connection mean.

BACKGROUND ART

Advertisement devices attracting the attention of consumers have continually grown in importance with the steady growth of products and services available. Certain types of advertisement devices have an information carrying or conveying surface. Typical examples are posters, billboards and similar items. Other types of advertisement devices are common everyday objects, like pens and key-holders, which attract the attention of consumers when in use. Known examples of these advertisement devices are disclosed in the Hungarian patent specifications HU 209.348 or HU 202.329.

Some of the advertisement devices are exhibited at publicly accessible locations, but many others appear in the workplace, shops, warehouses, or even at home. A common drawback of most devices is that they serve merely to display a static structure or assembly, together with the information they intend to convey to the public. Because of their static structure, they do not attract enough attention, quickly lose their novelty, and fade into their surroundings. These devices do not distribute the information efficiently. Hence, their advertising potential is not reached. To overcome this disadvantage, it has been proposed to use different sorts of moving means to combine the distributed information with motion. Moving images and objects are much more likely to attract the attention of otherwise inattentive people, so these devices are more efficient as advertisement means. Such point-of-sale advertising devices with moving objects sometimes serve to attract attention only, without having an information conveying surface. Examples of advertisement devices incorporating such moving means are known from, among others, the U.S. Pat. No. 4,949,486 (Belokin et al.) patent specification. Another moving advertising display device using magnets is described in the U.S. Pat. No. 3,964,190 (Leo) patent specification. Further, U.S. Pat. No. 4,827,642 (Chatten) teaches a drive mechanism for an advertising display or the like. The drive mechanism incorporates a quartz movement lo mechanism with a magnet attached to the stem of the clock movement. A counterpart magnet is attached to a rotatable display structure. The magnets are situated sufficiently close to one another so that rotation of the stem is transferred to the display structure. The rotatable structures disclosed by Chatten work only with a vertical axis of rotation, so the plane of rotation is horizontal. These structures are not applicable where traditional vertical advertising surfaces, as e. g. posters or billboards are used. Further, the rotating structures of Chatten are rotating in a totally predictable manner, and thereby quickly lose their novelty. From the U.S. Pat. No. 4,990,117 (Yonezawa), a magnetic force guided travelling toy, i.e. a magnetic car is known. The car is equipped with a magnet, which serves to keep the car on a predetermined path having magnetic material embedded in it. This document does not teach how to use the car as an advertising object. Also, the car is unable to follow a random route, because the embedded magnetic path determines the route that the magnetic car should follow. Further, this known solution does not indicate or teach the use of a strongly tilted or vertical surface for the magnetic car. Therefore, this solution can not be used in combination with traditional vertical advertising surfaces either.

While the known moving display devices show improved ability to attract consumer attention, they require relatively bulky housing for the driving mechanism. As a result, the very effect of the movement itself will not appear surprising, because the observers can relatively easily identify or imagine the driving mechanism which causes the movement. Hence, these known moving advertisement devices will quickly lose the attention which they managed to generate in the observers. Therefore, it is an object of the present invention to create a multipurpose advertisement device, which overcomes the drawbacks of the known advertisement devices comprising a moving part or element, and which provides a moving element capable of moving in a random manner on a vertical or strongly tilted advertising surface. Specifically, it is an object of the invention to create an advertisement device that has a moving object to attract the interest of the public, and where the movement of the moving object is experienced as very unusual and surprising by the observing persons. Also, it is an object of the invention to provide an advertisement device that is easy to manufacture, provides ample advertisement surface, and that may be used in a variety of environments.

SUMMARY OF THE INVENTION

The present invention provides a multipurpose advertisement device, with a carrier frame comprising one or more border parts, the border parts having an information carrying outer surface, with a mobile primary information carrying means for the displaying of characters and/or figures and/or other symbols for attracting attention, said primary information carrying means movably positioned on at least a part of the information carrying outer surface of the border parts, wherein the primary information carrying means is provided with first connecting means, and further the carrier frame is comprising an inner volume, said inner volume encompassing moving means, power connector means for connecting the moving means to a power source, said moving means comprising one or more transfer means, the transfer means comprising at least one flat disc and at least one second connecting means, with a sufficient attracting magnetic force between the said first and second connecting means to keep the primary information carrying means attached to the surface of the information carrying outer surface of the carrier frame in a stable manner. According to the invention, the transfer means further comprises at least one, flat part being relatively displaceable to the flat disc, and each of the flat parts comprising one or more second connecting means, where the movement of the flat part is determined by the frictional forces acting on the flat part. By the expression "in a stable manner" it is indicated that the magnetic force itself is enough to hold the primary information carrying means against the outer surface of the border part, and no other means are needed to secure to the border part the primary information carrying means and to prevent it from falling down, in any position of the border part. With other words, the primary information carrying means is kept in place only by the attracting magnetic force acting between the first connecting means and the second connecting means and by the reaction and/or frictional forces resulting from the magnetic force. As a result, the primary information carrying means is always resting against the secondary information carrying outer surface, and by moving the second connection means around behind the secondary information conveying surface, the primary information carrying means will follow this movement, attracting attention to itself and the secondary information carrying outer surface.

In a preferred embodiment, the information carrying surface with the primary information carrying means is inclined to the horizontal with an angle of 0–120 degrees. This will add to the surprising effect caused by the movement of the primary information carrying means. Advantageously, the carrier frame of the multipurpose advertisement device comprises two border parts, the ratio of the distance between the outer side of the border parts measured in cm to the total outer surface of the border parts measured in cm2 is not greater than 1:2000. In an especially preferred embodiment, the carrier frame is provided with one or more frame elements connected to the border parts, and at least one frame element is provided with a hidden compartment communicating with the inner volume, and the power source and/or power connector means and/or an electric motor of the moving means is positioned in the hidden compartment. In effect, such a flat construction with no apparent inner mechanism have proved to be highly puzzling to the observers, and improved the overall appearance of the multipurpose advertisement device. The surprising impression is improved, if at least part of the border parts are mirror plates. With the mirror plates it is even more clear that there is no visible connection between the primary information carrying means and the carrier frame.

Advantageously, the primary information carrying means is supported by at least three support means, preferably wheels, and/or gliding elements, and the primary information carrying means is rolling and/or gliding on the information carrying outer surface of the carrier frame on said support means. In a certain embodiment, it is preferred that the support means of the primary information carrying means are comprising at least one support means having a supporting surface with increased frictional coefficient and at least one support means having a supporting surface with a reduced frictional coefficient. It is also preferred that the second connection means is attached in a radial direction to the transfer means and/or to the flat part. This combination improves the driving properties of the toy car acting as the primary information carrying means. It must be stressed, however, that the invention is not limited to toy cars or similar vehicles as primary information carrying means, but a multitude of other embodiments may be used. As an alternative to the toy car, the advertised product itself or a characteristic part thereof, or any suitable object may be used for moving around on the information carrying surface of the border part.

In another preferred embodiment, the transfer means comprises at least one flat disc, the flat disc being connected through mechanical drive unit, preferably belt drive, friction drive, cogwheel drive or combination of these to the electric motor of the moving means. This allows a practical flat construction. Advantageously, the transfer means is provided with two or more second connecting means, and at least two of the second connecting means is connected to the transfer means in a manner permitting their displacement relative to each other. It is also suggested that the power connecting means are provided with means for randomly or periodically changing the direction and/or speed of the rotation of the electric motor. Thereby random movement of several primary information carrying means is possible. The random movement is further enhanced if the second flat part is pressed towards the flat disc by the magnetic attraction force acting between the first and second connection means, and the movement of the second flat part is determined by the frictional forces arising from the pressing towards the flat disc.

In a further preferred embodiment, the multipurpose advertisement device of the invention comprises at least two hanger means made of electrically conducting material, the hanger means being connected to the connecting wires placed in the inner volume of the carrier frame and/or the hidden compartment of the frame element. Thereby the power source need not be hidden in the device itself, and the construction may be even more flat.

Specifically, to reduce the friction arising between the flat disc and the border part. it is suggested that there is provided a mesh liner between the inner surface of the border part and the transfer means and/or the flat part, the mesh liner preferably containing lubricating material. The invention also relates to an improved multipurpose advertisement device, with a similar structure to the above described device, wherein the primary information carrying means is provided support means, preferably wheels and/or gliding elements. According to the invention, the support means of the primary information carrying means comprises at least one supporting surface with increased frictional coefficient and at least one supporting surface with a reduced frictional coefficient.

BRIEF DESCRIPTION OF DRAWINGS

By way of example only, an embodiment of the invention will now be described with reference to the accompanying drawing, in which FIG. 1. is a front view of the multipurpose advertisement device according to the invention, partly broken out.

BEST MODE FOR CARRYING OUT THE INVENTION

Figure 1:
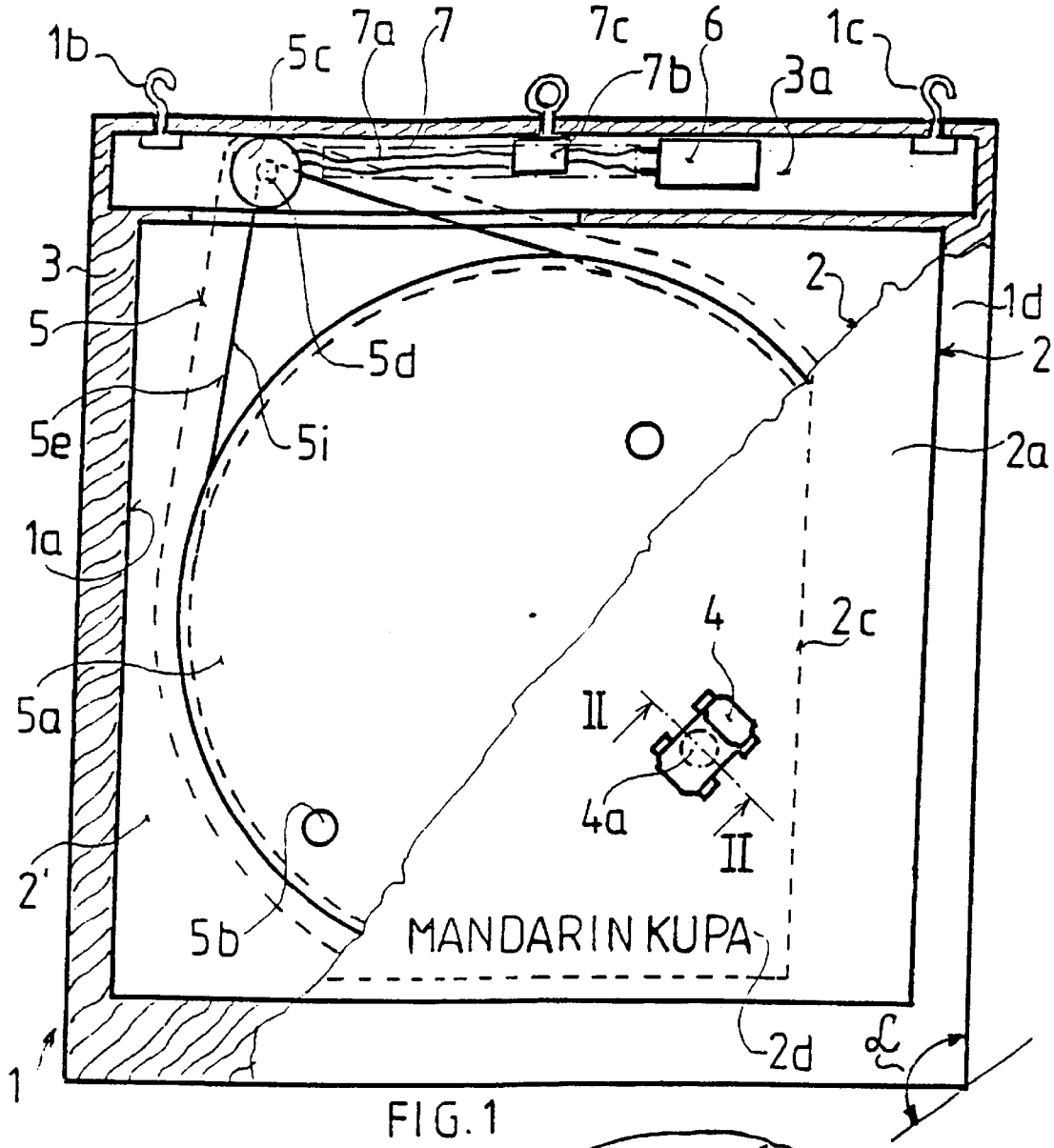

FIG. 1 shows an embodiment of the multipurpose advertisement device according to the invention. There is shown a carrier frame 1, presently comprising a frame made of wooden tetragonal frame elements 3, further comprising border part 2 positioned on the front surface 1*d* of the carrier frame 1, and further comprising another border part 2', the latter fixed on the 1*e* back surface (not shown in FIG. 1) of the carrier frame 1, the frame elements 3 and border parts 2 and 2' enclosing the inner volume 1*a* in the present invention. It must be stressed that the carrier frame 1 is positioned here so that the border part 2 is substantially vertical, i. e. the angle α to the horizontal is 90 degrees.

On the outer side 2*a* of the border part 2 there is an information conveying surface 2*c* with fixedly positioned secondary information carrying means 2*d*, and the primary information carrying means 4 comprising a first connection means 4*a* is positioned in a movable manner.

The inner volume 1*a* of the carrier frame 1 encloses a moving means 5, a power source 6 and the power connecting means 7. The moving means 5 comprises an electric motor 5*c*, the disc-shaped transfer means 5*a*, the mechanical drive means 5*e* presently belt drive—for realising driving connection between the axle 5*d* of the electric motor 5*c* and the transfer means 5*a*, and the second connection means 5*b*. With this embodiment, the 5*c* electric motor, the power source 6 and the power connecting means 7 are placed in the hidden compartment 3*a* formed in one of the wooden frame elements 3 of the carrier frame 1.

FIG. 1. shows also that the power connecting means 7 comprises connecting wires 7*a*, control switch 7*b* and the starter module 7*c*. The connecting wires 7*a* are connecting the electric motor 5*c* and the associated power source 6 in a manner so that the control switch 7*b*, which is capable of breaking the electrically conducting connection between the electric motor 5*c* and the power source 6 is placed between the two latter. The control switch 7*b* may have other controlling tasks assigned to it, e. g. the random change of the polarity of the voltage provided by the power source 6. Of course, the power source 6 itself may perform the same function. Control switch 7*b* is turned on—or off—by the starter module 7*c*, which, in order to be accessible, is at least partly extending from the inner volume 1*a* of the carrier frame 1, or in the present embodiment from the hidden compartment 3*a* supplementing the inner volume 1*a*. In order to hide the role of the starter module 7*c*, it is advantageously camouflaged, e.g. by forming its end extending from the hidden compartment 1*a* like a hanger, and thus making the impression that its role is the suspending of the multipurpose advertisement device.

The actual suspension of the shown embodiment of the multipurpose advertisement device is performed by the securing means 1*b* and 1*c* which are positioned partly in the inner volume 1*a* of the carrier frame 1 (in the current embodiment in the hidden compartment 3*a* of the frame element 3) and partly outside the carrier frame 1.

Figure 2:
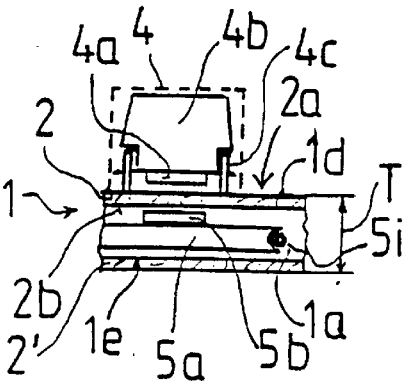
FIG. 2 is cross section taken along the line II of FIG. 1, FIG. 3. is a schematic of the electric circuit of the multipurpose advertisement device of the invention, FIG. 4. is a back view of another embodiment of the multipurpose advertisement device of the invention, partly broken out, FIG. 5. shows a perspective view of a third embodiment of the multipurpose advertisement device, FIG. 6A. is a back view of the third embodiment of the multipurpose advertisement device, shown in FIG. 5.

In FIG. 2, the relation between the primary information carrying means 4 and the transfer means 5*a* of the moving means 5 is shown. As mentioned above, the first connection means 4 should be placed on the outer side 2*a* of the border part 2 in a manner so that the first connection means 4 should be able to move easily with minimal resistance or friction. In order to achieve as little friction as possible, in this preferred embodiment the first connection means 4 is a car 4*b* provided with rollers 4*c*, e.g. with wheels, and within the car 4*b* is placed the first connection means 4*a*, which is preferably a permanent magnet. This embodiment has the further advantage that in a surprising manner the car 4*b* appear to have an engine, which is driving it around.

As seen in FIG. 2., the second connection means 5*b* is placed on the side of transfer means 5*a* which is looking toward the inner side 2*b* of the border part 2, close to the inner side 2*b* of the border part 2. Accordingly, the first connection means 4 should be placed on the outer side 2*a* of border part 2 so that the first connection means 4*a* is exactly above the second connection means 5*b*.

Concerning first connection means 4*a* and second connection means 5*b*, it is irrelevant which means is establishing the magnetic field and which means is being attracted in the magnetic field. However, the most effective combination is when both means are permanent magnets, but other combinations are also possible. The only demand is that the first connection means 4*a* and second connection means 5*b* couple should attract each other with sufficient force, and thus establish the necessary forced connection even through the border part 2 for keeping the first connection means 4*a*, and together with it the first connection means 4 on the vertical outer side 2*a* of the border part 2, and even while the first connection means 4*a* is moving.

It is also contemplated that the second connection means 5*b* and the transfer means 5*a* is an electromagnet or other electric winding, or a flat stator of an electric motor, or other known construction for creating moving magnetic field.

It is also apparent from FIG. 2. that the inner volume 1*a* enclosed by the border part 2 on the front face 1*d* of the carrier frame 1 and the border part 2' on the back face 1*e* of the carrier frame 1 is very narrow. In the present embodiment, the ratio between the distance T between the outer side 2*a* of the border parts 2 and 2' measured in cm, and the total area A of the outer side 2*a* of the border parts 2 and 2' measured in cm is not greater than 1:2000. Hence, the border parts 2 and 2' are very close to each other, and thus appear to be one solid body. This surprising effect is further enhanced by making the border parts 2 and 2' of mirror plates, because with this the overall appearance of the device is even more startling.

In its appearance, the embodiment of the multipurpose advertisement device shown in FIGS. 1 and 2. is a wall mirror, the carrier frame 1 of which is made of the double-sided mirror of the border parts 2 and 2' and wooden frame element 3, surrounding the double-sided mirror. On the outer side 2*a* of at least one of the border parts 2 and 2' there is one or more small-sized primary information carrying means 4, whose first connection means 4*a*, in co-operation with the second connection means 5*b* in the inner volume 1*a* of the carrier frame 1, presses the first connection means 4 to the outer side 2*a* of the border part 2 with the force resulting from the magnetic interaction, and does not allow the first connection means 4 to fall off the outer side 2*a*.

When using the multipurpose advertisement device according to the invention, the carrier frame 1 is suspended with the help of the fixing means 1*b* and 1*c* on the desired location, and the starting module 7*c* is inserted into the carrier frame 1, in the present embodiment into the frame element 3, and with this the control switch 7*b* is tripped over to the activated state. In an alternative embodiment, the starting module 7*c* or the control switch 7*b* may be used for regulating the direction and/or the speed of the rotation of the electric motor 5*c*, through a known control circuit (not shown). The control switch 7*b* will close the electric circuit, and the electric power will arrive at the electric motor 5*c* via the connecting wires 7*a*. As a result, the electric motor 5*c* will start, and will set in motion through its rotating axle 5*d* the mechanical drive 5*e*—here realised as belt 5*i*—, which latter will rotate the transfer means 5*a* of the moving means 5. The second connection means 5*b* will rotate together with the transfer means 5*a*, and due to the attraction force resulting from the magnetic interaction, the first connection means 4*a* and the attached first connection means 4 will rotate along on the outer side 2*a* of the border part 2, together with the second connection means 5*b*.

The multipurpose advertisement device of the invention may be realised in a multitude of embodiments, both with regard to the number, shape, size of the primary information carrying means 4, and with regard to the creation of the magnetic field to establish the forced connection between the first connection means 4*a* and the second connection means 5*b*.

It is important, however, that the generated magnetic force should be greater than the gravitational force of the primary information carrying means 4. Also, the torque exerted on the primary information carrying means 4 by the magnetic force and the reaction and/or friction forces between the primary information carrying means 4 and the information conveying surface 2*c* should be greater than the torque of the gravitational force. This last condition is important, in order for the first connection means 4 not only to remain attached to the information carrying outer surface of the multipurpose advertisement device, but to stay there in proper position, imitating real driving or other movement of the primary information carrying means 4. It is appreciated that the device of the invention also would function properly if the frictional forces between the primary information carrying means 4 and the border part 2 were zero. However, in some embodiments a little friction is desirable, to add the illusion of real driving to the movements of the primary information carrying means 4.

Using suitable electromagnets and electronics it is also possible to position those in the inner volume 1*a* between the border parts 2 and 2', or in the hidden compartment 3*a* of the frame elements 3. It must be noted that the magnetic attraction force between the first connection means 4*a* and the second connection means 5*b* must be tuned rather precisely. Firstly, the attraction force must be sufficient to keep the first connection means 4 pressed towards the outer side 2*a* of the border part 2 in any position, particularly in a vertical position. Secondly, the attraction force must not exceed this necessary force very much, because in this case the flat disc 5*f* will be pressed too strongly towards the border part 2, and the friction between them will be too high to overcome for a relatively weak electric motor 5*c*.

It is also obvious for a person skilled in the art that the overall size of the multipurpose advertisement device of the invention is not limited, and open-air versions are also possible.

Figure 3:
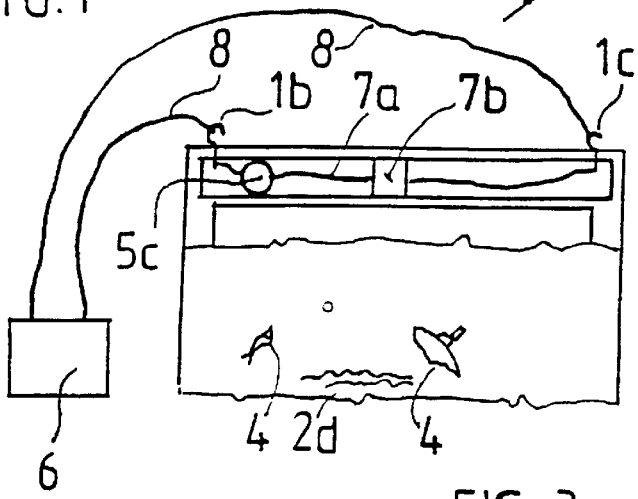

FIG. 3. shows a detail of a further embodiment of the multipurpose advertisement device, where the power source 6 is located outside the carrier frame 1, separated physically from the latter. The supply of electric energy to the electric motor 5*c* is made as follows:

The fixing means 1*b* and 1*c* used for suspending the carrier frame 1 are functioning as electric connectors as well, so these must be made of electrically conducting material. The fixing means 1*b* is connected directly to the electric motor 5*c*, while the fixing means 1*c* is connected to the electric motor 5*c* with the connecting wires 7*a* through the control switch 7*b*.

Connecting the power source 6 to the fixing means 1*b* and 1*c* via the connectors 8, the power source 6, the control switch 7*b* and the electric motor 5*c* will form one circuit, and the supply of electric energy to the electric motor 5*c* will be possible. It must be noted that in this case, if the multipurpose advertisement device is exhibited in an easily accessible space, the power source 6 must have a low operating voltage, in order to avoid any accidents.

It is also straightforward that the border part 2 need not have a planar surface, but may be provided with other forms as well. The movement of the first connection means 4 need not follow a circular path either, but may be guided along a non-circular path. Of course, in this case the transfer means 5*a* and the affixed second connecting means 5*b* must follow the particular surface and path of the border part 2. If the 5 moving, means and the transfer means 5*a* is not made as a mechanical construction, but comprises a chain of electromagnets, or the stator of a flat electric motor, than this latter condition is easily fulfilled.

Figure 4:
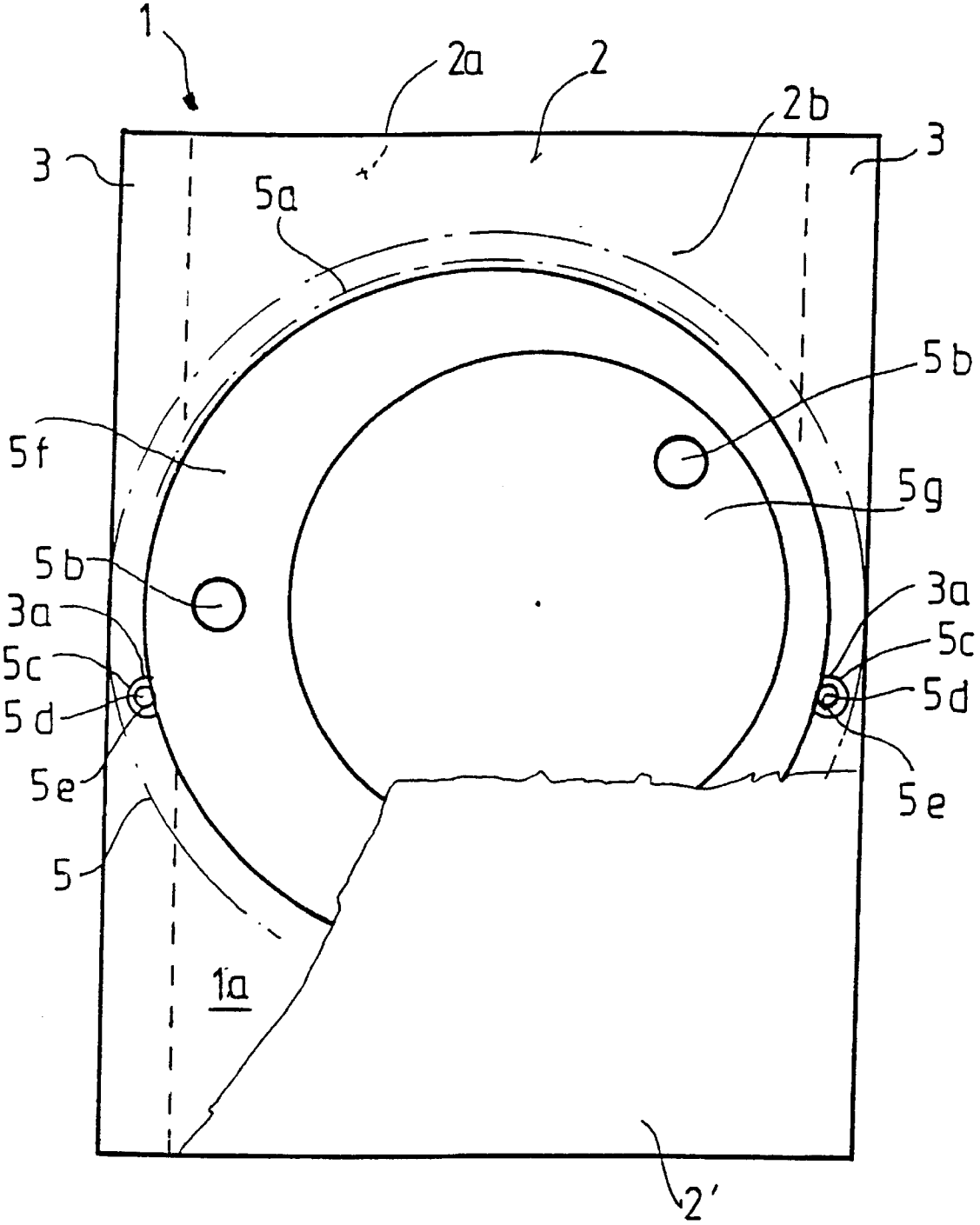

FIG. 4. shows a further embodiment of the multipurpose advertisement device, where the transfer means 5*a* are constructed using a flat disc 5*f* and further using the flat part 5*g*, which may be displaced relative to each other. The flat disc 5*f* and the flat part 5*g* are all equipped with a second connection means 5*b*. In this case the flat part 5*g* is realised as a flat disc itself, with its axis of rotation positioned somewhat eccentric to the axis of the flat disc 5*f*.

For better understanding of its structure, FIG. 4. shows the multi-purpose advertisement device from the back side, with the back border part 2' partly taken away. With this embodiment, the two parallel border parts 2 are interconnected with the vertical frame elements 3. The two border parts 2 are made of thin mirror plates, and are inclined with an angle $\alpha$ of 90 degrees to the horizontal. There is a hidden compartment 3*a* in each frame element 3, and there is an electric motor 5*c* in both frame elements 3 in the hidden compartments. On the axle 5*d* of the electric motors 5*c* there are mechanical drive means 5*e*, here constructed as friction discs. The mechanical drive means 5*e* are in a driving connection with the flat disc 5*f*, because the flat disc 5*f* is pressing against the mechanical drive means 5*e* under its own weight. The friction discs of the mechanical drive means 5*e* and the flat disc 5*f* have a relatively large friction coefficient, enough to rotate the flat disc 5*f* with friction drive.

The second, smaller and disc shaped flat part 5*g* is attached in a rotating, but eccentric manner to the flat disc 5*f* having a larger diameter. Both the flat disc 5*f* and the flat part 5*g* is equipped with at least one second connection means 5*b*, which are each holding a first connection means 4*a* to the outer side 2*a* of the border part (not shown in FIG. 4.) from the front face 1*d* of the carrier frame 1, under the influence of the magnetic attraction described earlier. The moving of the first connection means 4 is effected with the activating of the electric motors 5*c*.

When rotating the first flat disc 5*f*, the second flat part 5*g* will rotate as well, due to the friction force caused by the adhesion between them, but the rotation of the flat part 5*g* will have a different angular speed. The difference will be further increased by the breaking effect of the back border part 2' on the second flat part 5*g*. The overall result will be that the second connection means 5*b* attached to the flat disc 5f and the flat part 5*g* will move on a strange path with changing speed, both in relation to each other and to the border part 2. The outside observing person will see two cars 4*b* as first connection means 4 on the information conveying surface 2*c* of the border part 2, the cars 4*b* apparently chasing each other on a strange route or path. The multipurpose advertisement device shown on the figures and the transfer means 5*a* may be realised in a very flat construction, and the inner volume 1*a* between the border parts 2 and 2' need not be more than a few mm wide. Providing a more sophisticated controlling circuit to vary the speed and direction of the motors 5*c*, the movement of the cars 4*b* will appear to be fully random. Thus the multipurpose advertisement device will prove very effective in attracting attention.

The intriguing nature of the multipurpose advertisement device according to the invention is further enhanced, if the multipurpose advertisement device is suspended in free space, with its back border part 2' being visible and accessible. The overall appearance of, the multipurpose advertisement device have proved to be very puzzling to the observers, if the both the front and back border parts 2 and 2' are made of mirror glass. A further puzzling effect is achieved, if the border parts 2 and 2' together with the main elements of the transfer means 5*a*, as the flat disc 5*a* and the flat parts 5*g*, are made of transparent or semi-transparent material, and the multipurpose advertisement device is illuminated from the back. In this latter case the observers will practically not see the movement mechanism within the carrier frame 1, but: perceive the carrier frame 1 to be transparent (the non-transparent magnets are always covered by the cars 4*b*), so the apparently autonomous movement of the cars 4*b* will seem even more mysterious. For a perfect result, the rotating parts could be made of a clear transparent material, e. g. glass, and the inner volume of the carrier frame could be filled with a liquid having a refractive index equal to the refractive index of the glass. In certain embodiments, it may be preferred to cover one or both of the border parts 2 and 2' with a semi-transparent mirror, i. e. a mirror that is transparent from one side, but reflecting from the other side. E. g. if the back border part 2' is covered with a layer acting like a semi-transparent mirror, the advertisement device could be illuminated from the back side (some light would pass through the layer even when illuminated from the reflecting side). The viewing persons looking at the device from the front side would be able to see through device without seeing the non-transparent parts of driving mechanism —the magnets —, because they would be covered by the primary information carrying means. This would enhance the mysterious nature of the advertisement device. But if someone would try to look at the device from the back side, the magnets under the primary information carrying means could become visible. Therefore, it is advantageous to cover the back side with a non-transparent, e. g. reflecting surface, so that the magnets in the driving mechanism would be hidden.

Figure 5:
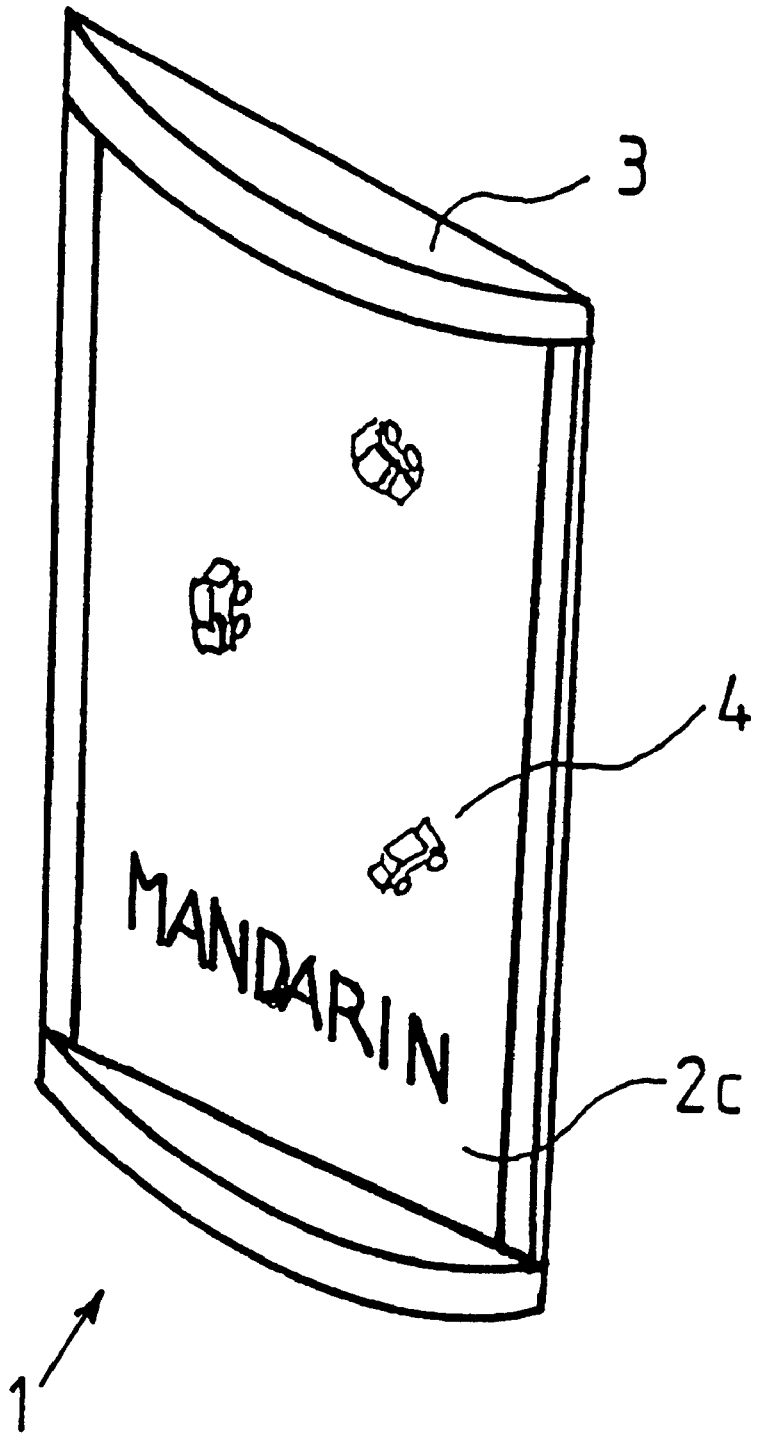
Figure 6A:
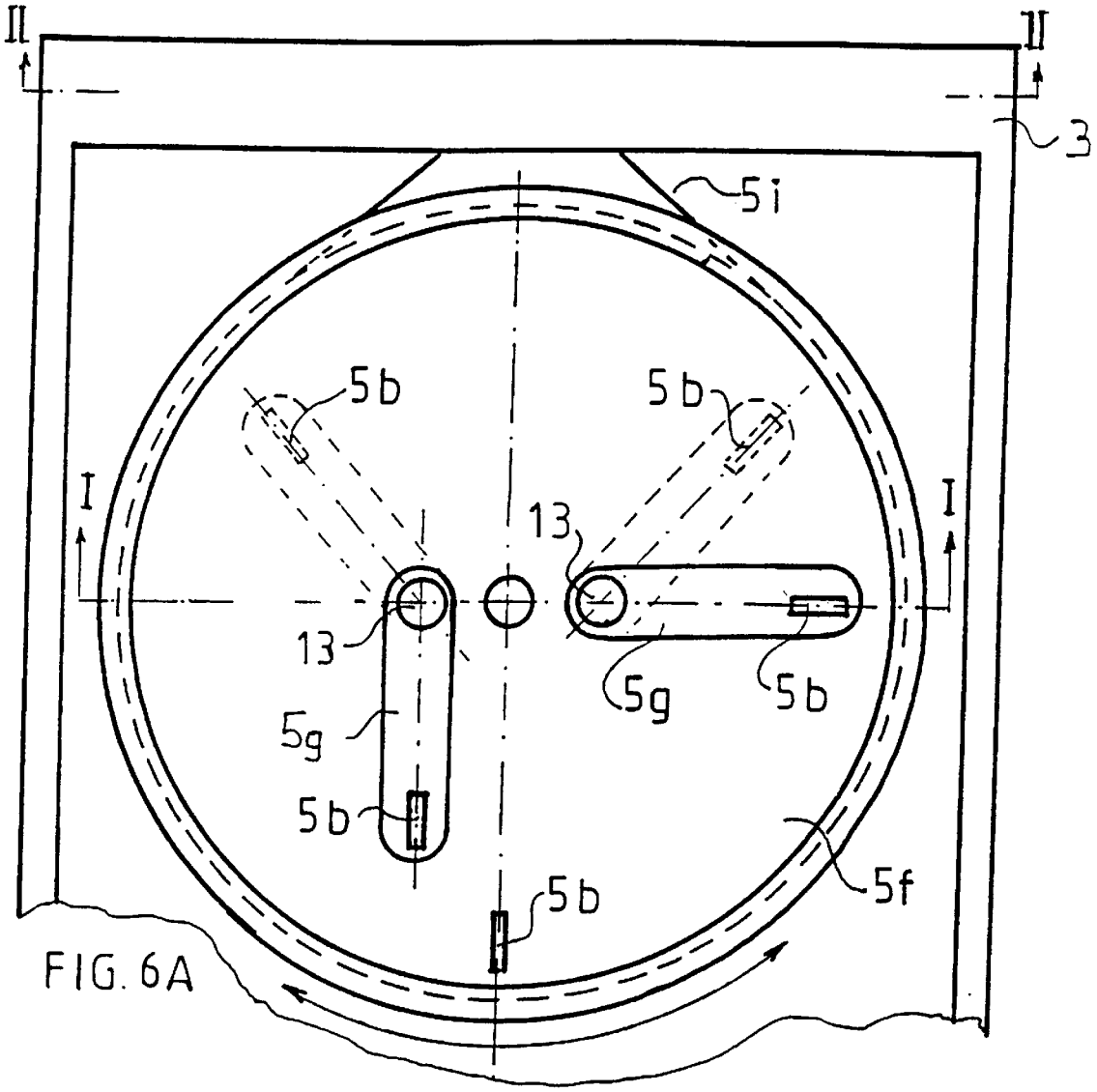
FIG. 6B. is a cross section taken along the line I—I of FIG. 6A.
FIG. 6C. is a cross section taken along the line II—II of FIG. 6A.
Figure 6B:
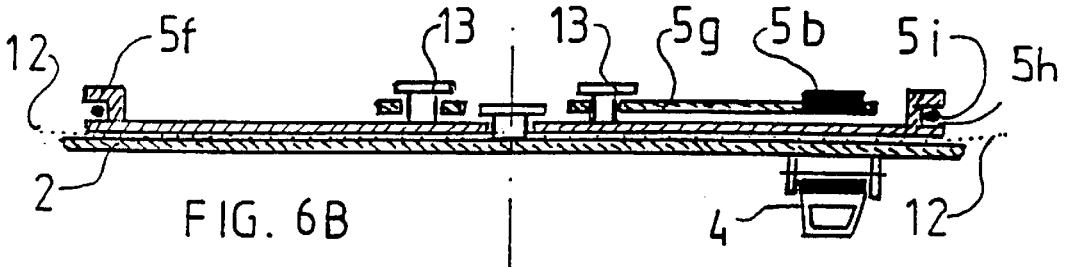
Figure 6C:
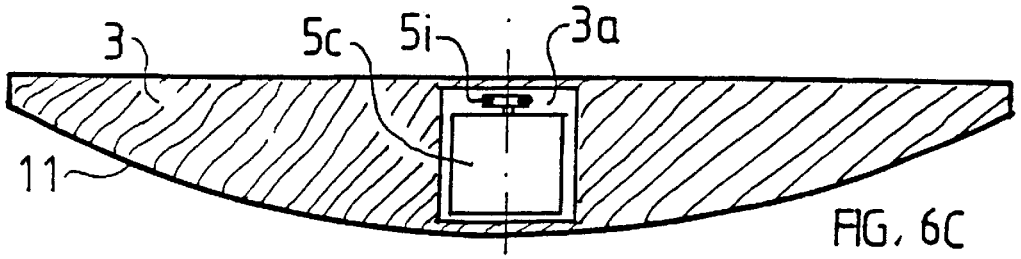
Figure 7:
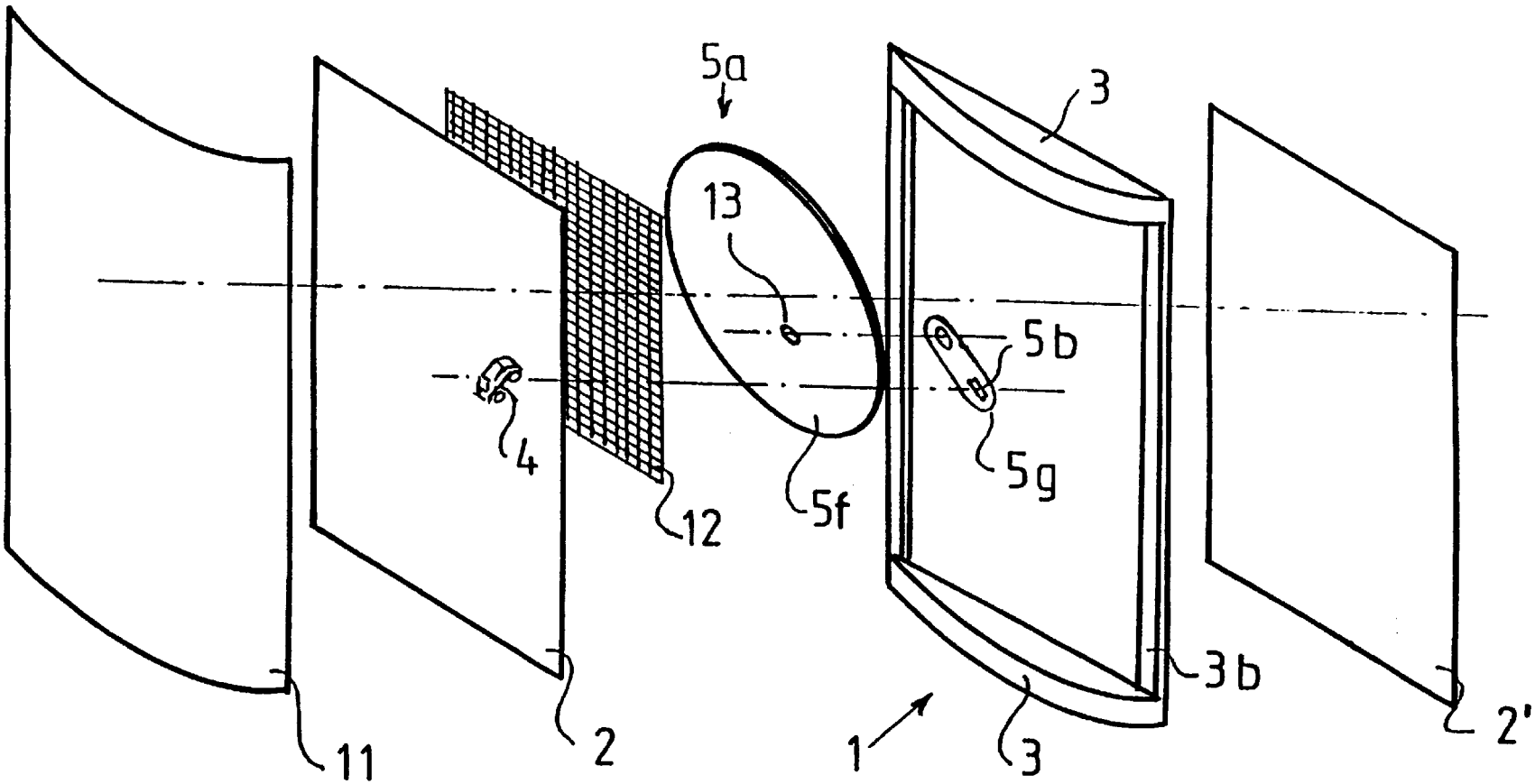
FIG. 7. is an exploded view of the embodiment shown in FIG. 5.

Another preferred embodiment of the multipurpose advertisement device according to the invention is illustrated in detail in FIGS. 5 to 7. This embodiment shares the basic features with the embodiments shown in FIGS. 1 to 4, except that some small, but essential improvements are added. The same reference numbers denote the identical parts.

FIG. 5 is a perspective view of the multipurpose advertisement device in the preferred embodiment. The lower and upper horizontal frame elements 3 have an arching outer contour, so that the outer side 2*a* of border part 2 may be covered with an arched cover: 11. The arched cover 11 may be of glass or transparent plastic sheet. The preferred material is plastic, being cheaper and readily formed to the required arching shape. Glass may be used where scratch-resistance is an important concern. Below the arched cover there are several first connection means 4, again in the form of toy cars. Covering the outer surface 2*a* of the border part 2, the dirt sensitive mechanics of the toy cars and the mirror surface on the outer surface 2*a* are well protected, and this construction lends itself for outdoor use.

The mechanical construction of this preferred embodiment of the multipurpose advertisement device is explained in detail with reference to FIGS. 6A to 6C, where FIG. 6A is a back view of the multipurpose advertisement device, with the border part 2' taken away. FIG. 6B is a cross section taken along line I—I of FIG. 6A, showing the construction of the mechanical drive system, while FIG. 6C is a cross section taken along: line II—II of FIG. 6A. As seen on the FIGS. 6A–C, similarly to the embodiment in FIG. 4, the transfer means 5*a* include the flat disc 5*f*, and the flat parts 5*g*. The flat disc 5*f* is rotated with a belt drive, the belt 5*i* running in the groove 5*h* in the perimeter of the flat disc 5*f*. Attached to the flat disc 5*f* there are two flat parts 5*g*, but here the flat parts 5*g* are not disc-shaped, but elongated. The flat parts 5*g* have their axis of rotation fixed eccentrically to the flat disc 5*f*. The eccentric location of the axis of rotation will result in a seemingly random movement of the primary information carrying means 4, if the rotation direction of the flat disc 5*a* is changed randomly or periodically. This latter is effected by an appropriate control circuit (not shown), connected between the power source 6 and the electric motor 5*c*. By fine-tuning the friction between the flat parts 5*g* and the flat disc 5*a*, an almost perfect random movement may be achieved.

The function of the axle for the rotation is performed by the discs 13, which may be regarded as very short and very thick axles. This construction is preferred instead of traditional thinner axles, because in this manner the axles, i. e. the discs 13 can easily be fastened e. g. by gluing to the flat disc 5*a*, while securing mechanically a thin and short axle to the thin sheet of the flat disc 5*a* would be very difficult. The secondary connecting means 5*b* are here made of elongated, flat plates of permanent magnets attached to the flat parts 5*g* and to the flat disc 5*a*. This form of the magnets are preferred, as compared to the round magnets shown in FIGS. 1 and 4, because the elongated magnets may be flatter, and further the elongated magnets with a similar elongated magnetic counterpart serving as first connection means 4*a* are better for keeping the cars 4*b* in a stable direction. This enhances the illusion that the cars 4*b* are driving around with the help of their own engines and wheels. When round magnets are used, the cars 4*b* tend to move in a more erratic manner. On the other hand, round magnets are needed with the magnetic axis perpendicular to the plane of the movement, if the cars 4*b* have to change their direction very often, e.g. because the flat disc 5*f* is randomly rotating and often changes rotating direction. In this case the natural movement of the cars 4*b* is further improved if the front wheels have lower friction resistance against side movement, while the rear wheels are only allowed to roll forwards or backwards. E. g. the front wheels may have a harder plastic cover, which allows the gliding or skidding to the side if the car 4*b* is forced to take a turn. The rear wheels may have a soft rubber tyre, which do not allow the swinging of the rear part to the sides. It must be noted that the primary information carrying means 4 need not have rolling wheels at all, but may be equipped with gliding supports or other functionally similar support means as well. In some embodiments this solution may be preferred to the wheels, because plastic gliding supports move more quietly, while rolling plastic wheels may generate a slight noise. For best results, the magnetic axis of the elongated magnet constituting the first connection means 4*a* in the car 4*b* is positioned perpendicularly to the length of the car 4*b* and parallel to the plane of the movement, between the front and rear wheels, approximately in the middle between the front and back wheels. The magnetic axis of the elongated magnet serving as second connecting means 5*b* on the flat parts 5*g* and the flat disc 5*f* should be placed in a radial orientation, also parallel to the plane of the movement, with the magnetic poles oriented such that the front part of the cars 4*b* should be attracted towards the forward direction of the movement. It must be noted that this configuration of the magnets is recommended if the flat disc 5*f* does not change the direction of rotation while the advertisement device is switched on.

Generally, the weight of the cars 4*b* should be reduced to the extent possible.

Therefore, it is advantageous to use small, moulded plastic toy cars.

As seen in FIG. 6C, the arched frame element 3 provides ample space for a hidden compartment 3*a*, at the same time not being an obvious place for hiding the electric motor 5*c*, where curious observers of the multipurpose advertisement device would look for the driving mechanics. The hidden compartment 3*a* is even better camouflaged if the frame element 3 is made of wood, because a wooden frame is normally regarded as a solid body, without containing cavities. FIG. 7 is an exploded view of the preferred embodiment of the multipurpose advertisement device, the constituting layers taken apart for better understanding. The core of the moving means 5 and the transfer means 5*a*, the flat disc 5*f* and the flat part 5*g* is layered between the back border part 2' and front border part 2. The border parts 2' and 2 are kept apart by the side frames 3*b* of the carrier frame 1. In order to reduce wear on the flat disc 5*a* and the inner side of the border part 2, which are permanently pressed towards each other by the first connection means 4 and second connection means 5*b*, it is advisable to use some sort of lubricant. But the large contacting surfaces would result in the sticking together of the surfaces, even with a very thin lubricant. Therefore, it has been found that inserting a mesh liner 12 between the flat disc 5*f* and the border part 2 eliminates the sticking together of the surfaces, and at the same time provides the necessary lubrication. The mesh liner 12 may be of a thin, dense plastic net, available e.g. as mosquito net. The outer side of the border part 2 and the first connection means 4 thereon are covered and protected by the transparent arched cover 11.

The multipurpose advertisement device according to the invention may find use in a variety of environments, for providing information and advertising space combined with an original, intriguing background that will inevitably attract the attention of the public.

What is claimed is:

1. Multipurpose advertisement device, comprising:

a carrier frame, said carrier frame comprising:

one or more border parts having an information carrying outer surface, a mobile primary information carrying means for displaying characters, figures and symbols for attracting attention, said primary information carrying means being movably positioned on at least a part of said information carrying outer surface of the border parts, said primary information carrying means further being provided with first connection means, said carrier frame having an inner volume, said inner volume encompassing moving means, and power connector means for connecting the moving means to a power source, said moving means comprising one or more transfer means, said transfer means comprising at least one flat disc and at least one second connecting means, with an attracting magnetic force between said first and second connecting means to keep the primary information carrying means attached to the surface of the information carrying outer surface frame in a stable manner, in which said transfer means further comprises at least one flat part, said flat part being relatively displaceable with respect to said flat disc, said flat part comprising at least one of said second connecting means, and wherein movement of said flat part is determined by frictional forces acting on the flat part due to said attracting magnetic force between said first and second connecting means and a relative displacement between said flat part and said flat disc.

2. The multipurpose advertisement device according to claim 1, in which the information carrying surface with the primary information carrying means is inclined with respect to a horizontal plane at an angle of 0–120 degrees.

3. The multipurpose advertisement device according to claim 1, in which the carrier frame comprises two said border parts, where a ratio of a distance between outer sides of the border parts measured in cm to a total area of outer surfaces of the border parts measured in $cm^2$ is not greater than 1:2000.

4. The multipurpose advertisement device according to claim 1, in which said moving means includes an electric motor, said power connector means comprising a control switch and connecting wires, the connecting wires connecting the electric motor to the control switch and to the power source.

5. The multipurpose advertisement device according to claim 1, in which the carrier frame is provided with one or more frame elements connected to the border parts, and at least one of said frame elements is provided with a hidden compartment communicating with said inner volume, at least one of said power source, said power connector means and said electric motor of the moving means being positioned in said hidden compartment.

6. The multipurpose advertisement device according to claim 1, in which at least a part of the border parts are mirror plates.

7. The multipurpose advertisement device according to claim 1, in which at least one of the first connecting means and the second connecting means is made of permanent magnetic material.

8. The multipurpose advertisement device according to claim 1, which said primary information carrying means is supported by at least three support means.

9. The multipurpose advertisement device according to claim 8, in which at least one of said support means is a wheel, and the primary information carrying means is rollable on the information carrying outer surface of the carrier frame on said wheel.

10. The multipurpose advertisement device according to claim 8, in which at least one of said support means is a gliding element, and the primary information carrying means is glidable on the information carrying outer surface of the carrier frame on said gliding element.

11. The multipurpose advertisement device according to claim 8, in which said at least one of the support means of the primary information carrying means has a supporting surface with a increased frictional coefficient, and at least one other of said support means has a supporting surface with a reduced frictional coefficient.

12. The multipurpose advertisement device according to claim 4, in which the flat disc is connected by a mechanical drive unit, to the electric motor of the moving means.

13. The multipurpose advertisement device according to claim 12, in which said mechanical drive unit comprises a belt drive, a friction drive, a cogwheel drive or a combination thereof.

14. The multipurpose advertisement device according to claim 1, in which said transfer means is provided with two or more of said second connecting means, and at least two of said second connecting means are connected to the transfer means for displacement relative to each other.

15. The multipurpose advertisement device according to claim 14, in which said second connection means is connected to the transfer means via an eccentric, rotating connection located on at least one of the flat disc of the transfer means and said flat part.

16. The multipurpose advertisement device according to claim 4, comprising at least two hanger means made of electrically conductive material, said hanger means being connected to said connecting wires.

17. The multipurpose advertisement device according to claim 4, wherein said second connecting means is elongated and is attached in a radial direction to at least one of said transfer means, said flat disc part.

18. The multipurpose advertisement device according to claim 1, in which said power connector means includes means for randomly or periodically changing at least one of speed and direction of rotation of the electric motor.

19. The multipurpose advertisement device according to claim 15, in which at least one of said flat discs or said flat part is provided with a third flat disc as a rotating axle.

20. The multipurpose advertisement device according to claim 1, comprising a mesh liner between the inner surface of the border part and the transfer means.

21. The multipurpose advertisement device according to claim 20, in which said mesh liner contains lubricating material.

* * * * *